US007937900B1

(12) United States Patent
Gaffney et al.

(10) Patent No.: US 7,937,900 B1
(45) Date of Patent: May 10, 2011

(54) METAL ROOF RETROFIT SKYLIGHT

(75) Inventors: Steven M. Gaffney, Athens, GA (US); Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 344 days.

(21) Appl. No.: 12/361,196

(22) Filed: Jan. 28, 2009

Related U.S. Application Data

(60) Provisional application No. 61/027,107, filed on Feb. 8, 2008.

(51) Int. Cl.
*E04D 1/36* (2006.01)

(52) U.S. Cl. ..... 52/200; 52/58; 52/209

(58) Field of Classification Search ..... 52/58, 60–62, 52/200, 204.67, 211, 213, 209, 204.53, 656.7, 52/656.5, 656.1, 656.2
See application file for complete search history.

(56) References Cited

U.S. PATENT DOCUMENTS

| | | | | |
|---|---|---|---|---|
| 4,570,399 | A * | 2/1986 | Wentink | 52/208 |
| 4,825,608 | A | 5/1989 | Makin | |
| 5,018,333 | A * | 5/1991 | Bruhm | 52/741.4 |
| 5,046,292 | A * | 9/1991 | Sampson et al. | 52/200 |
| 5,323,576 | A | 6/1994 | Gumpert et al. | |
| 5,586,415 | A * | 12/1996 | Fisher et al. | 52/58 |
| 6,047,507 | A * | 4/2000 | Lappin et al. | 52/212 |
| 6,269,597 | B1 * | 8/2001 | Haas | 52/203 |
| 6,360,499 | B1 * | 3/2002 | Sugiura | 52/204.597 |
| 6,401,401 | B1 * | 6/2002 | Williams | 52/58 |
| 7,631,464 | B2 * | 12/2009 | Valentz et al. | 52/200 |
| 7,740,928 | B2 * | 6/2010 | Mehta et al. | 428/40.1 |
| 7,754,304 | B1 * | 7/2010 | Hohmann, Jr. | 428/40.1 |
| 7,788,855 | B2 * | 9/2010 | Mileti et al. | 52/58 |
| 2001/0034984 | A1 * | 11/2001 | Murphy et al. | 52/204.5 |

* cited by examiner

*Primary Examiner* — Brian E Glessner
*Assistant Examiner* — Beth Stephan
(74) *Attorney, Agent, or Firm* — Donald J. Ersler

(57) ABSTRACT

A metal roof retrofit skylight preferably includes a glazing pane, a pane retention frame and at least one self-stick sealing sheet. The pane retention frame preferably includes a bottom leg and a top leg. One end of the bottom and top legs preferably form a fastening flange. The other end of the top is offset from the bottom leg to form a pane space that is sized to receive a thickness of the glazing pane. Each self-stick sealing sheet includes a sealing sheet and release paper. The sealing sheet is applied over a portion of the glazing pane and a membrane roofing material to provide a seal between the membrane roofing material and the glazing pane. An optional condensation collector is installed in a skylight opening in the metal roof. The metal roof retrofit skylight is attached to the metal roof around a perimeter of the skylight opening.

19 Claims, 8 Drawing Sheets

METAL ROOF RETROFIT SKYLIGHT

CROSS-REFERENCES TO RELATED APPLICATIONS

This is a nonprovisional patent application taking priority from provisional application No. 61/027,107 filed on Feb. 8, 2008.

BACKGROUND OF THE INVENTION

1. Field of the Invention

The present invention relates generally to metal roofs and more specifically to a metal roof retrofit skylight, which allows a skylight in a metal roof to be efficiently replaced with a new skylight.

2. Discussion of the Prior Art

Many pre-engineered structures use skylights to provide the interior of the building with natural lighting. By allowing natural light into the interior of the building, energy consumption is reduced. Commonly, at the time of re-roofing, a membrane roof system is selected. It appears the prior art does not disclose a method of preserving or efficiently replacing existing skylights in the metal roof. Consequently, the skylights are covered over with the new roofing system, thereby eliminating the natural day lighting of the building and increasing energy consumption.

U.S. Pat. No. 4,825,608 to Makin discloses a flush mounted self-flashing dual pane skylight. The Makin patent includes a skylight, which is preferably rectangular and is made up of upper and lower light transmitting panes having two mutually opposed side edges and opposed top and bottom edges. U.S. Pat. No. 5,323,576 to Gumpert et al. discloses a metal roofing skylight. The Gumpert et al. patent includes a skylight system and method of making the same for use on metal roofs, such as those of the standing seam variety in which the edges of the light admitting opening are folded back away from the opening to form a lip surrounding the opening.

Accordingly, there is a clearly felt need in the art for a metal roof retrofit skylight, which allows a skylight in a metal roof to be easily replaced with a new skylight, when a metal roof is replaced with a membrane roofing material.

SUMMARY OF THE INVENTION

The present invention provides a metal roof retrofit skylight, which allows a skylight in a metal roof to be efficiently replaced. The metal roof retrofit skylight preferably includes a glazing pane, a pane retention frame and at least one self-stick sealing sheet. The glazing pane is preferably a multi-layer polycarbonate sheet, but other materials may also be used. The pane retention frame preferably includes a bottom leg and a top leg. One end of the bottom and top legs preferably contact each other at one end to form a fastening flange. The other end of the top leg is offset from the bottom leg to form a pane space that is sized to receive a thickness of the glazing pane. Each self-stick sealing sheet includes a sealing sheet and a sheet of release paper. A pressure sensitive adhesive is applied to an underside of the sealing sheet and covered with the sheet of release paper. The sealing sheet is applied over a portion of the glazing pane and a membrane roofing material to provide a seal between the membrane roofing material and the glazing pane.

An optional condensation collector preferably includes four corner trough members and four lengthwise trough members. Each corner trough member includes a first trough, a second trough and a fastening flange. One end of the first trough communicates with one end of the second trough at substantially a right angle. The fastening flange extends from a top of the first and second troughs. Each lengthwise trough member includes a lengthwise trough and a lengthwise fastening flange. The lengthwise fastening flange extends from a top of the lengthwise fastening flange.

The optional condensation collector may be installed in a preexisting skylight opening formed in the metal roof or in a newly formed skylight opening. A perimeter of the skylight opening is preferably less than a perimeter of the glazing panel. A collector sealant is preferably applied adjacent an edge of the skylight opening. A single corner trough member is inserted into each corner of the skylight opening. The lengthwise trough of each lengthwise trough member is inserted into the first or second troughs of the corner trough members. A plurality of fasteners are inserted through the fastening flanges of the corner and lengthwise trough members to secure the corner and lengthwise trough members to the roof.

The metal roof retrofit skylight is preferably installed in the following manner. If a condensation collector is used, a thermal sealant is applied to the bottom leg, adjacent the glazing pane. The fastening flange of the pane retention frame is attached to the roof with a plurality of fasteners. Each self-stick sealing sheet is applied over a portion of the glazing pane and a membrane roofing material to provide a seal between the membrane roofing material and the glazing pane.

Accordingly, it is an object of the present invention to provide a metal roof retrofit skylight, which allows a skylight in a metal roof to be easily replaced with a new skylight, when a metal roof is replaced with a membrane roofing material.

These and additional objects, advantages, features and benefits of the present invention will become apparent from the following specification.

DETAILED DESCRIPTION OF THE PREFERRED EMBODIMENTS

Figure 6:
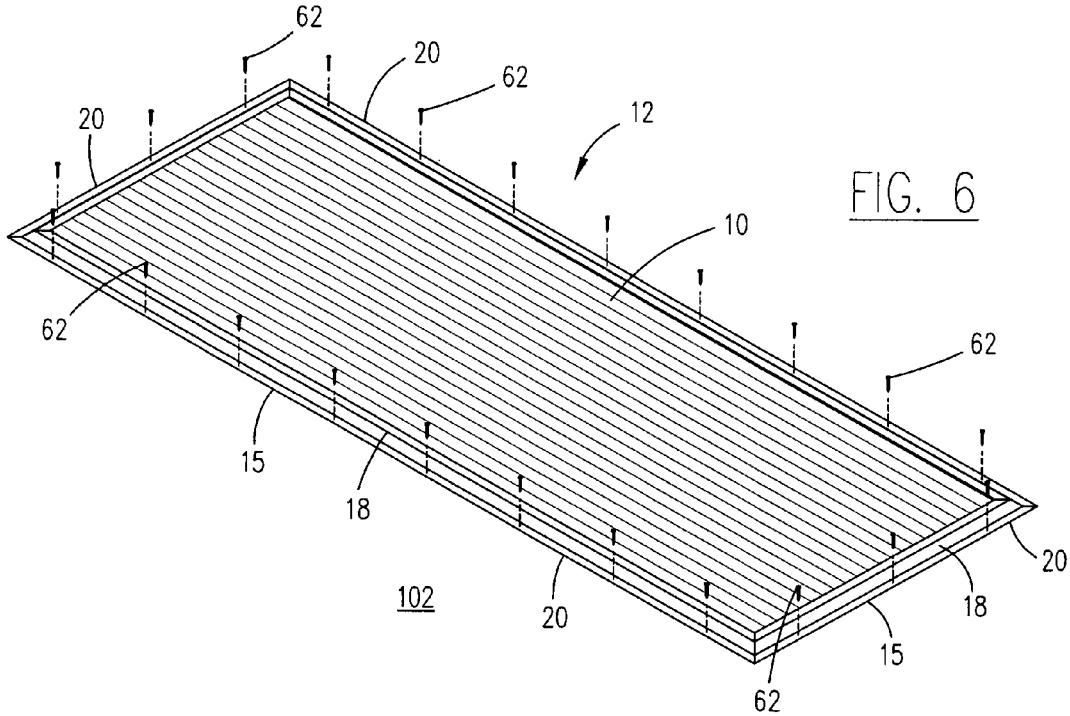
FIG. 6 is a perspective view of a metal roof retrofit skylight being fastened to a metal roof with a plurality of fasteners in accordance with the present invention.
Figure 7:
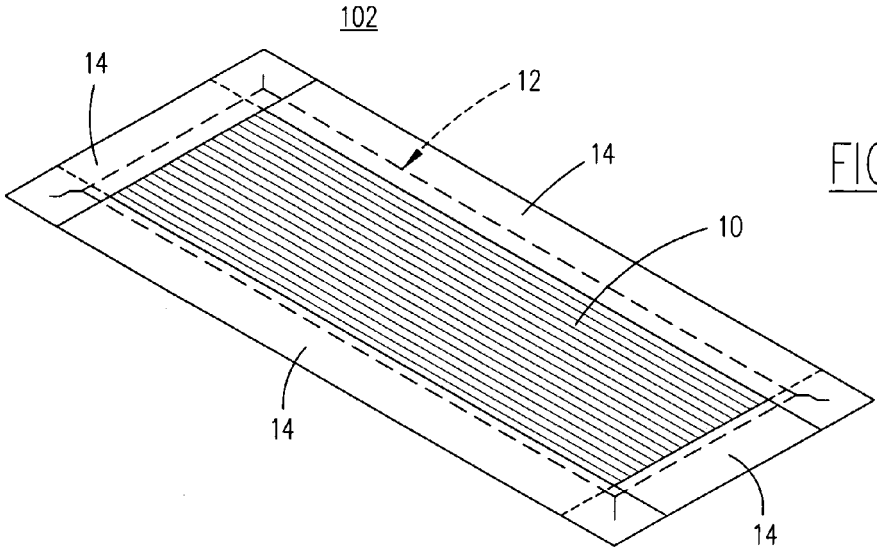
FIG. 7 is a perspective view of at least one self-stick sealing sheet applied to a metal roof retrofit skylight and a membrane roofing material in accordance with the present invention.
Figure 7A:
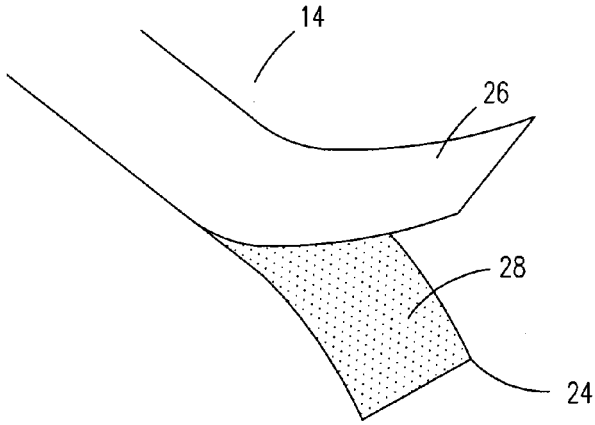
FIG. 7*a* is a perspective view of a self-stick sealing sheet with a sealing sheet separated from a sheet of release paper of a metal roof retrofit skylight in accordance with the present invention.
Figure 8:
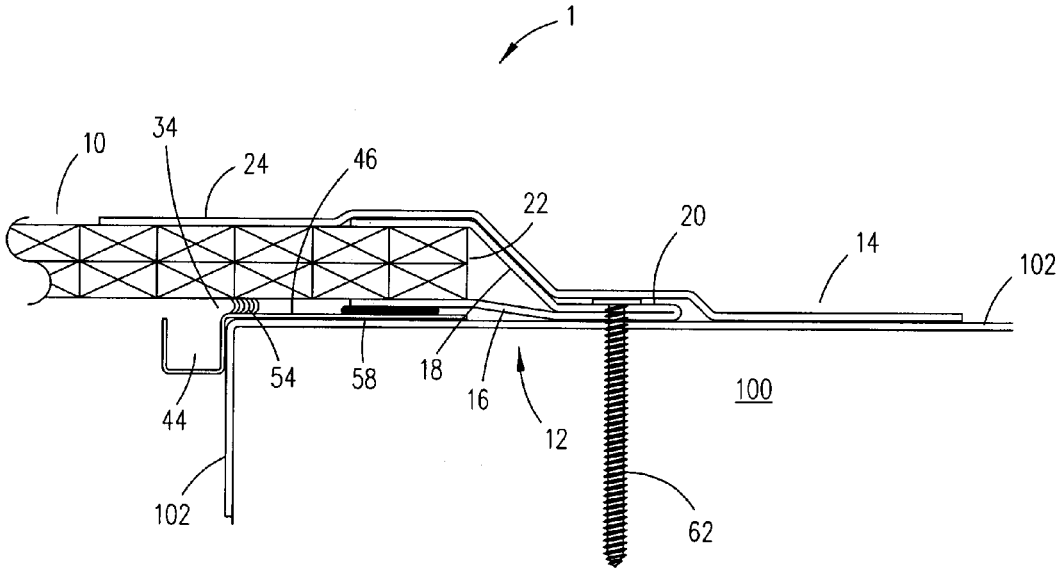
FIG. 8 is an end cross sectional view of a metal roof retrofit skylight with a condensation collector in accordance with the present invention.

With reference now to the drawings and particularly to FIG. 8, there is shown an end cross sectional view of a metal roof retrofit skylight 1. With reference to FIGS. 6-7*a*, the metal roof retrofit skylight 1 preferably includes a glazing pane 10, a pane retention frame 12 and at least one self-stick sealing sheet 14. The glazing pane 10 is preferably a multi-layer polycarbonate sheet, but other materials may also be used, such as tempered glass or acrylic.

Figure 5:
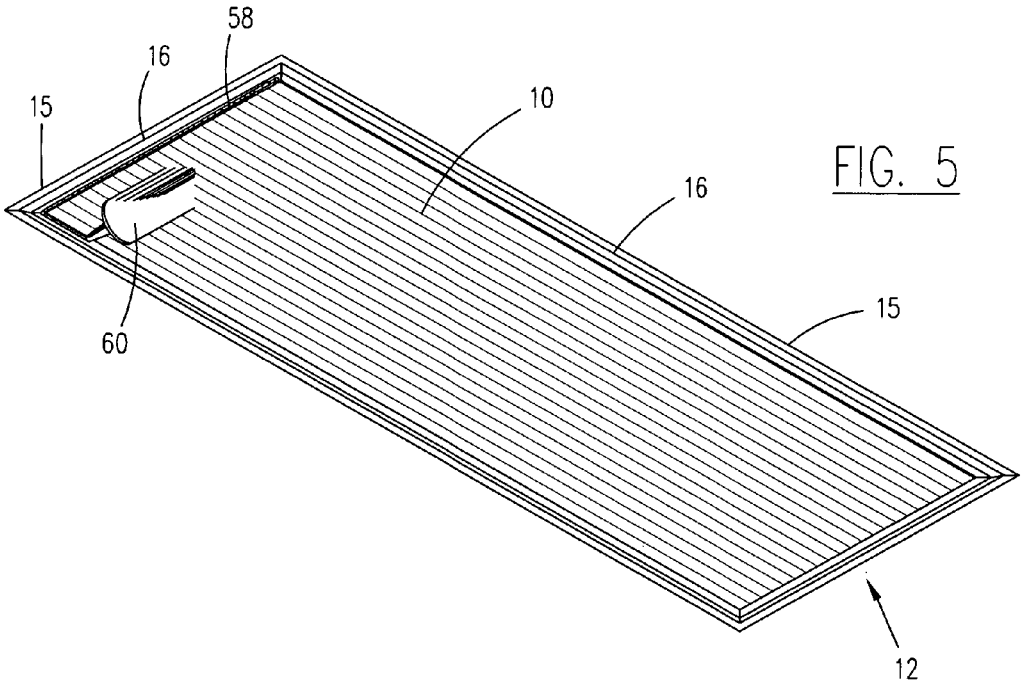
FIG. 5 is a perspective view of a thermal sealant being applied to a bottom leg of a metal roof retrofit skylight in accordance with the present invention.

With reference to FIG. 5, the pane retention frame 12 preferably includes four frame portions 15 that are preferably mitered on each end, similar to a picture frame. Ends of the frame portions 15 are joined to each other with welding, mechanical bonding, adhesive or any other suitable process. The frame portions 15 may be fabricated from a metal, a plastic or any other suitable material and manufactured through extrusion, bending or molding. Each frame portion 15 preferably includes a bottom leg 16 and a top leg 18. One end of the bottom and top legs preferably contact each other at one end to form a fastening flange 20. The other end of the top leg 18 is offset from the bottom leg 16 to form a pane space 22. The pane space 22 is sized to receive a thickness of the glazing pane 10. Each frame portion 15 is preferably fabricated from a single piece of material.

Each self-stick sealing sheet 14 includes a sealing sheet 24 and a sheet of release paper 26. A pressure sensitive adhesive 28 is applied to an underside of the sealing sheet 24 and covered with the sheet of release paper 26. The sealing sheet 24 is applied over substantially a perimeter of the glazing pane 10 and a membrane roofing material 102 to provide a seal between the membrane roof material 102 and the glazing pane 10. The pressure sensitive adhesive 28 provides the seal between the membrane roof material 102 and the glazing pane 10. The sealing sheet 24 must be suitable for adhering to both the glazing pane 10 and the membrane roof material 102 and forming a seal with both the glazing pane 10 and the membrane roof material 102. Four separate sheets of the self-stick sealing sheet 14 are preferably applied to the membrane roof material 102 and the glazing pane 10. However, a single self-stick sealing sheet with a pane opening may also be used. Additionally, any other suitable sealing device may substituted for the at least one self-stick sealing sheet 14.

Figure 1:
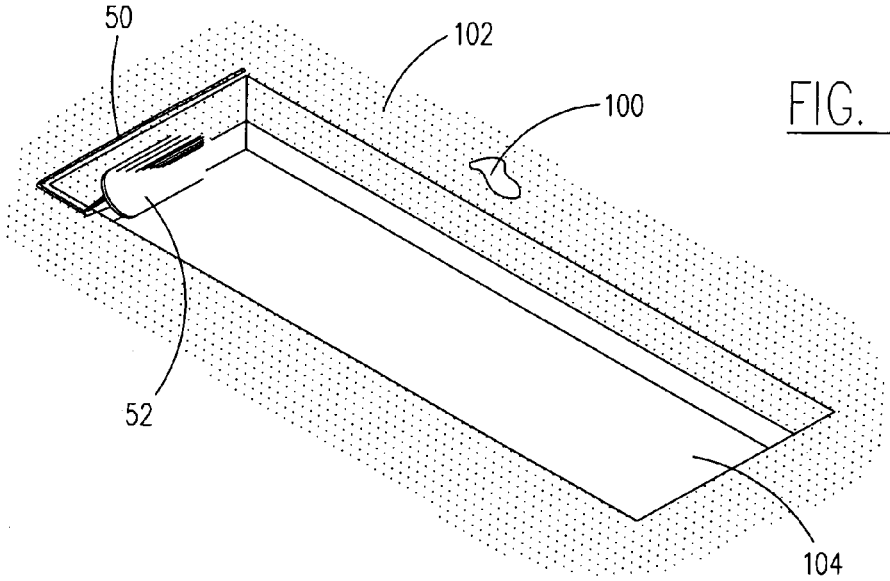
FIG. 1 is a perspective view of a membrane roofing material laid into a skylight opening and a sealant applied adjacent a perimeter of the skylight opening for installation of a metal roof retrofit skylight in accordance with the present invention.
Figure 2:
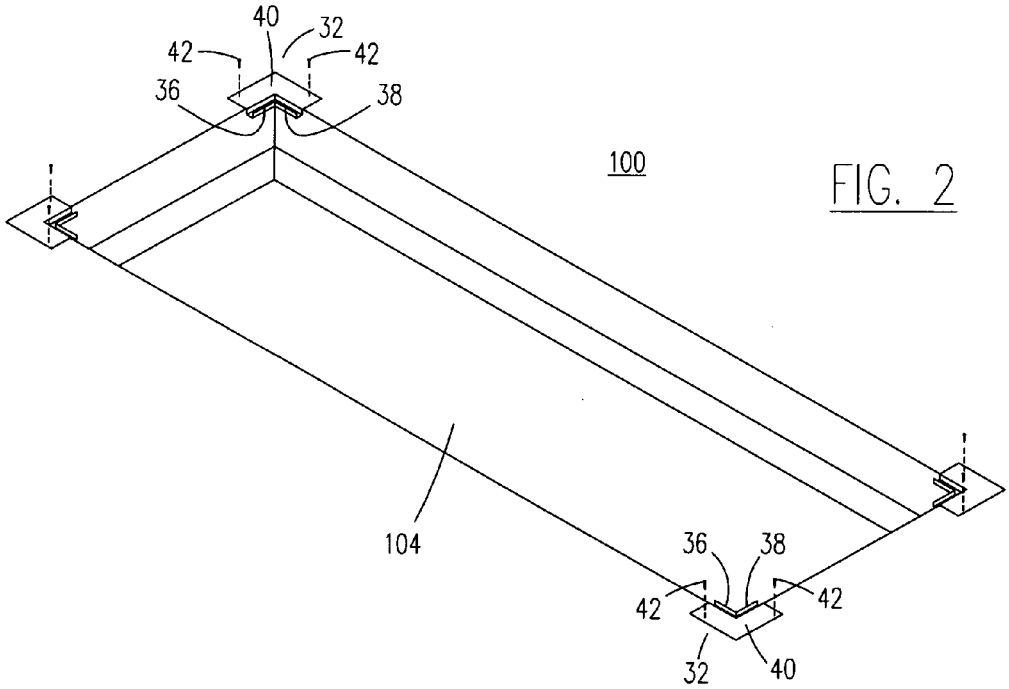
FIG. 2 is a perspective view of four corner trough members inserted into each corner of a skylight opening for installation of a metal roof retrofit skylight in accordance with the present invention.
Figure 3:
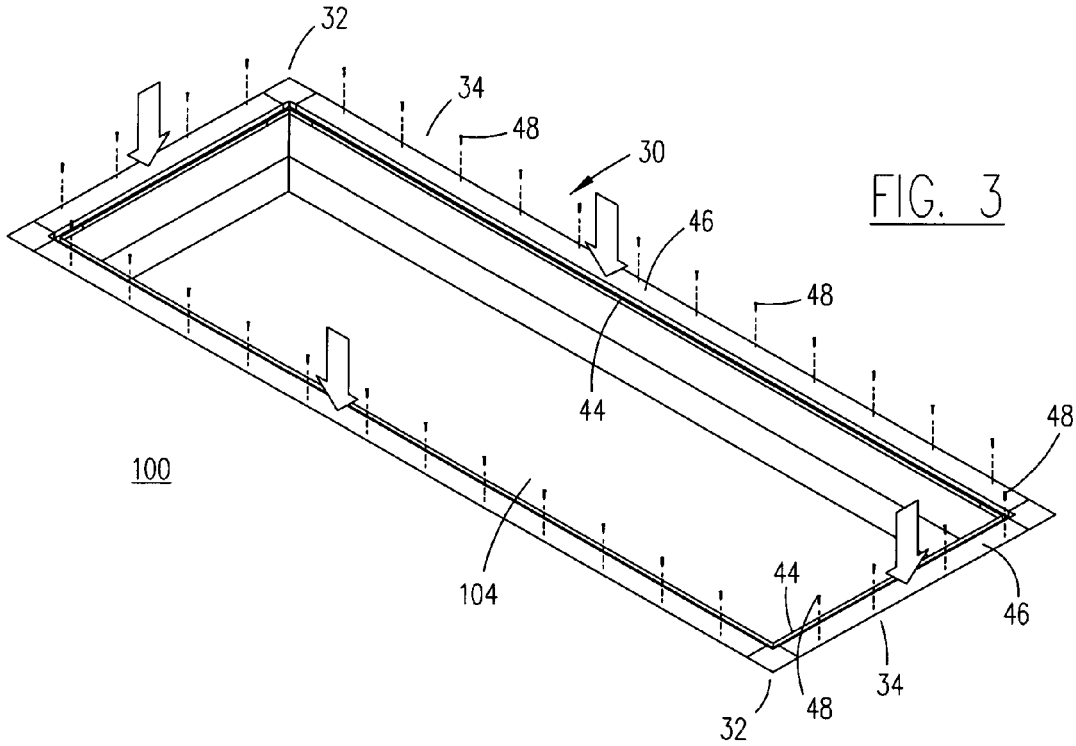
FIG. 3 is a perspective view of four lengthwise trough members inserted into four corner trough members for installation of a metal roof retrofit skylight in accordance with the present invention.

With reference to FIGS. 1-3, an optional condensation collector 30 preferably includes four corner trough members 32 and four lengthwise trough members 34. Each corner trough member 32 includes a first trough 36, a second trough 38 and a fastening flange 40. One end of the first trough 36 communicates with one end of the second trough 38 at substantially a right angle. The fastening flange 40 extends from a top of the first and second troughs. The four corner trough member 32 are attached to the metal roof 100 with a plurality of fasteners 42. Each lengthwise trough member 34 includes a lengthwise trough 44 and a lengthwise fastening flange 46. The lengthwise fastening flange 46 extends from a top of the lengthwise fastening flange 44. The four lengthwise troughs 44 are attached to the metal roof 100 with a plurality of fasteners 48.

The optional condensation collector 30 may be installed in a preexisting skylight opening 104 formed through the metal roof 100 or in a newly formed skylight opening. A perimeter of the skylight opening 104 is preferably less than a perimeter of the glazing panel 10. A collector sealant 50 is preferably applied adjacent a perimeter edge of the skylight opening 104 with a sealant dispenser 52 to seal the four corner trough members 32 and four lengthwise trough members 34 to the membrane roofing material 102.

Figure 4:
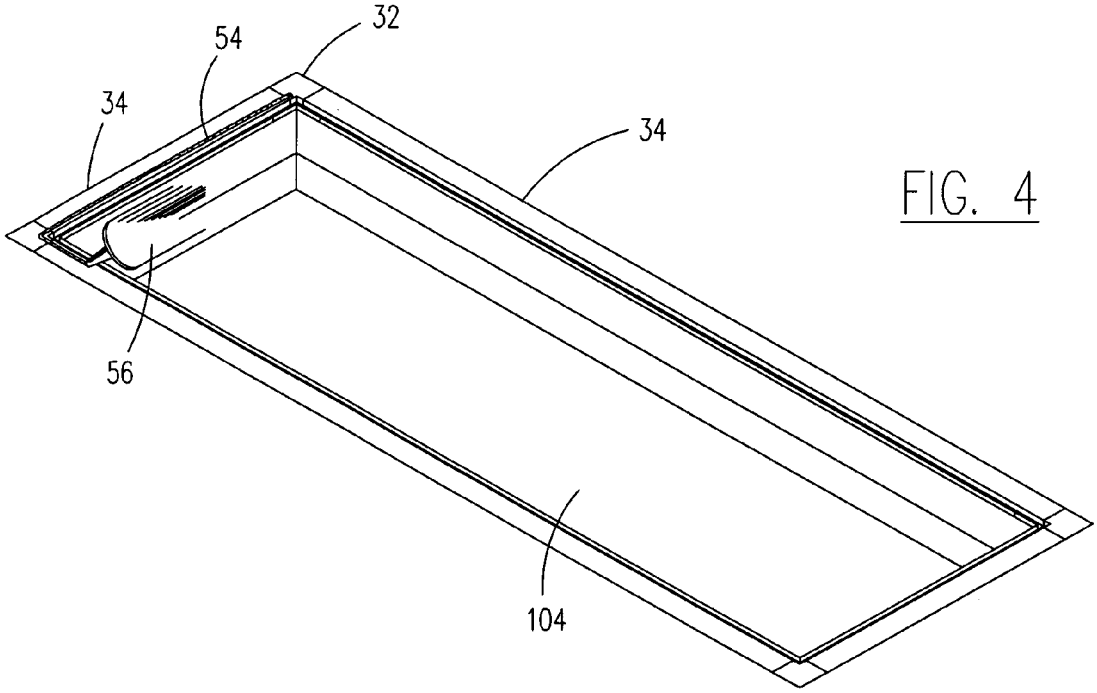
FIG. 4 is a perspective view of a condensation collector installed in a skylight opening and a sealant applied to a perimeter of the condensation collector for installation of a metal roof retrofit skylight in accordance with the present invention.

With reference to FIG. 4, a single corner trough member 32 is inserted into each corner of the skylight opening 104. Inner perimeters of the first and second corner troughs are sized to receive an outer perimeter of the lengthwise trough 44 to facilitate insertion of the lengthwise trough 44 into the first and second troughs of the corner trough members 32. If a condensation collector 30 is used, a condensation sealant 54 is applied to a top of the four corner trough members 32 and four lengthwise trough members 34 to condensation seal the condensation collector 30 to the bottom legs 16 of the frame portions 15.

With reference to FIG. 5, the metal roof retrofit skylight 1 is preferably installed in the following manner. If a condensation collector 30 is used, a thermal sealant 58 is applied to the bottom leg 16 of the four frame portions 15, adjacent the glazing pane 10 with a thermal sealant dispenser 60. The fastening flange 20 of the pane retention frame 12 is attached to the metal roof 100 with a plurality of fasteners 62. Each self-stick sealing sheet 14 is applied over a portion of the glazing pane 10 and the membrane roofing material 102 to provide a seal between the membrane roofing material and the glazing pane 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A roof retrofit skylight for installation in a roof covered with a membrane roofing material, comprising:

a glazing pane; and a pane retention frame including a bottom leg, a top leg and a fastener flange, a pane space being created between said first and second legs to receive a thickness of said glazing pane, said fastener flange for attachment to the roof, wherein a perimeter of said glazing pane is sealed to the membrane roofing material with at least one self-stick sealing sheet attached over a portion of said glazing pane and the membrane roofing material.

2. The roof retrofit skylight for installation in a roof covered with a membrane roofing material of claim 1, further comprising:

a condensation collector being located under substantially a perimeter of said glazing pane.

3. The roof retrofit skylight for installation in a roof covered with a membrane roofing material of claim 2, further comprising:

said condensation collector including four corner trough members and four lengthwise trough members.

4. The roof retrofit skylight for installation in a roof covered with a membrane roofing material of claim 3, further comprising:

each one of said four corner trough members includes a first trough, a second trough and a fastening flange, one end of said first trough communicates with one end of the second trough at substantially a right angle, said fastening flange extends from a top of said first and second troughs.

5. The roof retrofit skylight for installation in a roof covered with a membrane roofing material of claim 3, further comprising:

each one of said four lengthwise trough members includes a lengthwise trough and a lengthwise fastening flange, said lengthwise fastening flange extends from a top of said lengthwise trough.

6. The roof retrofit skylight for installation in a roof covered with a membrane roofing material of claim 1 wherein:

said glazing pane is a multi-layer polycarbonate sheet.

7. A roof retrofit skylight for installation in a roof covered with a membrane roofing material, comprising:

a glazing pane;

a pane retention frame surrounding said glazing pane, said pane retention frame including a bottom leg, a top leg and a fastener flange, a pane space being created between said first and second legs to receive a thickness of said glazing pane, said fastener flange for attachment to the roof; and at least one self-stick sealing sheet being attached over substantially a perimeter of said glazing pane and the membrane roofing material.

8. The roof retrofit skylight for installation in a roof covered with a membrane roofing material of claim 7, further comprising:

a condensation collector being located under substantially said perimeter of said glazing pane.

9. The roof retrofit skylight for installation in a roof covered with a membrane roofing material of claim 8, further comprising:

said condensation collector including four corner trough members and four lengthwise trough members.

10. The roof retrofit skylight for installation in a roof covered with a membrane roofing material of claim 9, further comprising:

each one of said four corner trough members includes a first trough, a second trough and a fastening flange, one end of said first trough communicates with one end of the second trough at substantially a right angle, said fastening flange extends from a top of said first and second troughs.

11. The roof retrofit skylight for installation in a roof covered with a membrane roofing material of claim 9, further comprising:

each one of said four lengthwise trough members includes a lengthwise trough and a lengthwise fastening flange, said lengthwise fastening flange extends from a top of said lengthwise trough.

12. The roof retrofit skylight for installation in a roof covered with a membrane roofing material of claim 7 wherein:

said glazing pane is a multi-layer polycarbonate sheet.

13. The roof retrofit skylight for installation in a roof covered with a membrane roofing material of claim 7, further comprising:

said self sealing sheet including a sealing sheet and a sheet of release paper, a pressure sensitive adhesive being applied to an underside of said sealing sheet, said sheet of release paper being applied to said pressure sensitive adhesive.

14. A roof retrofit skylight for installation in a roof covered with a membrane roofing material, comprising:

a glazing pane;

a pane retention frame including a bottom leg, a top leg and a fastener flange, a pane space being created between said first and second legs to receive a thickness of said glazing pane, said fastener flange for attachment to the roof;

a condensation collector being located under substantially a perimeter of said glazing pane; and at least one self-stick sealing sheet being attached over a portion of said glazing pane and the membrane roofing material.

15. The roof retrofit skylight for installation in a roof covered with a membrane roofing material of claim 14, further comprising:

said condensation collector including four corner trough members and four lengthwise trough members.

16. The roof retrofit skylight for installation in a roof covered with a membrane roofing material of claim 15, further comprising:

each one of said four corner trough members includes a first trough, a second trough and a fastening flange, one end of said first trough communicates with one end of the second trough at substantially a right angle, said fastening flange extends from a top of said first and second troughs.

17. The roof retrofit skylight for installation in a roof covered with a membrane roofing material of claim 15, further comprising:

each one of said four lengthwise trough members includes a lengthwise trough and a lengthwise fastening flange, said lengthwise fastening flange extends from a top of said lengthwise trough.

18. The roof retrofit skylight for installation in a roof covered with a membrane roofing material of claim 14 wherein:

said glazing pane is a multi-layer polycarbonate sheet.

19. The roof retrofit skylight for installation in a roof covered with a membrane roofing material of claim 14, further comprising:

said self sealing sheet including a sealing sheet and a sheet of release paper, a pressure sensitive adhesive being applied to an underside of said sealing sheet, said sheet of release paper being applied to said pressure sensitive adhesive.

* * * * *